United States Patent [19]

Aberkrom

[11] Patent Number: 4,538,848

[45] Date of Patent: Sep. 3, 1985

[54] GRAB

[75] Inventor: Peter Aberkrom, Nieuwerkerk a/d IJssel, Netherlands

[73] Assignee: Nemag B.V., Deltastraat, Netherlands

[21] Appl. No.: 551,721

[22] Filed: Nov. 14, 1983

[30] Foreign Application Priority Data

Nov. 12, 1982 [NL] Netherlands ..... 8204386

[51] Int. Cl.[3] ..... B66C 3/12

[52] U.S. Cl. ..... 294/68.23; 37/185; 294/111

[58] Field of Search ..... 294/70, 71, 111, 112; 37/183 R, 184–187; 414/624

[56] References Cited

U.S. PATENT DOCUMENTS

| | | | |
|---|---|---|---|
| 1,571,838 | 2/1926 | Hutson . | |
| 1,909,867 | 5/1933 | Olson . | |
| 2,617,211 | 11/1952 | Olson | 37/185 |
| 3,544,150 | 12/1970 | Huuksloot | 294/71 |
| 3,716,265 | 2/1973 | Huuksloot | 294/70 |
| 4,395,066 | 7/1983 | Huuksloot | 294/70 |

FOREIGN PATENT DOCUMENTS

| | | | |
|---|---|---|---|
| 1816869 | 7/1970 | Fed. Rep. of Germany . | |
| 2060360 | 6/1972 | Fed. Rep. of Germany . | |
| 2924628 | 3/1981 | Fed. Rep. of Germany | 294/70 |
| 3030472 | 3/1982 | Fed. Rep. of Germany | 294/70 |
| 569369 | 4/1924 | France . | |
| 2156135 | 5/1973 | France . | |
| 2483383 | 12/1981 | France . | |
| 6414230 | 6/1966 | Netherlands . | |
| 1545591 | 5/1979 | United Kingdom . | |

*Primary Examiner*—Johnny D. Cherry

*Attorney, Agent, or Firm*—Scully, Scott, Murphy & Presser

[57] ABSTRACT

A grab comprising two grab buckets (2,3) pivoted together by means of plate-like carrier arms (15,16,22,23) mounted on a pivotal shaft (8). The carrier arms (15,16,22,23) extend from the bottom of a bucket to beyond the pivotal shaft (8) and are substantially parallel to each other. The carrier arms (15,16) of one bucket (2) are located on opposite sides of a median plane perpendicular to the pivotal shaft. The two carrier arms (15,16) are interconnected at least at their ends (19) and provided with guide pulleys and "close" pulleys (11,12) for guiding the closing ropes (6). The ends (27,28) of the carrier arms (22,23) of the other bucket (3) are made of double-walled construction by means of stiffening plates (25,26) connected to them in spaced relationship thereto. The carrier arms are arranged to pass by each other, so that the grab can be fully opened (FIG. 2*b*). Closing ropes (6) are secured to the ends of the carrier arms (22,23) of the other bucket (3).

11 Claims, 7 Drawing Figures

GRAB

Figure 1:
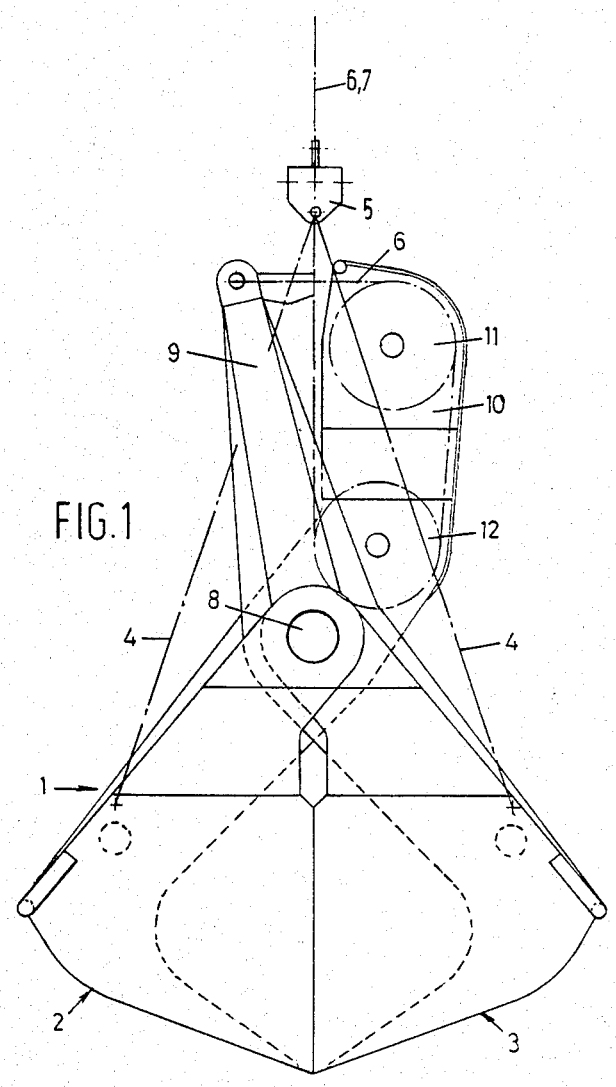

This invention relates to a grab.

A prior grab of the type to which the present invention relates is described in Netherlands patent application 6711272, now Netherlands Pat. No. 159,934. This prior grab comprises two buckets pivoted together by means of pairs of plate-like carrier arms, said carrier arms extending beyond the pivotal axis and, in the open position of the grab, being located in side-by-side relationship, each carrier arm of at least one pair of carrier arms associated with one bucket being of substantially planar shape, which carrier arms of that pair are connected together at their ends, which end is provided with guide pulleys and "close" pulleys for guiding the closing ropes, each bucket being connected to a yoke by means of one or more ropes.

This prior grab has a large number of excellent service characteristics, achieved mainly owing to the carrier arms being offset inwardly relatively to the side walls of the grab buckets. A structural problem in this connection is that the ends of the two pairs of carrier arms are interconnected, between which ends parts of the pulley box are arranged with guide pulleys and "close" pulleys, as well as "push" pulleys for the closing ropes. A "push" pulley in this connection means one which causes the closing rope, in the open position of the grab, to pass at some distance over the pivot point in order that the grab may be closed with less effort, i.e., with a smaller tensile force in the rope. This construction renders it necessary that at least of one pair of carrier arms, the portions located beyond the pivotal axis should be located inwardly of the carrier arms of the other grab bucket for the simple reason that, otherwise, the ends of the carrier arms could not pass each other. One pair of carrier arms, therefore, is divided, the portion intermediate the grab bucket and the pivotal axis being located outwardly of the carrier arms of the other grab bucket, while the portion beyond the pivotal axis is located inwardly of the carrier plates of the other grab bucket. This leads necessarily to a rather expensive and heavy pivot construction, because the torque brought about in the carrier arms by the closing forces is mainly transferred by way of this pivot by torsion.

It is an object of the present invention to provide a grab of the type described above, which is structurally simpler and lighter in weight. For this purpose, the grab according to the invention is characterized in that each carrier arm of the other bucket is also substantially of planar shape throughout its length, the portion of this carrier arm located beyond the pivotal shaft being provided with a stiffening plate spaced from that carrier arm portion, the end of said stiffening plate being connected to the end of this carrier arm to form a tine in which the end of a closing rope is secured.

As, in a grab thus formed, the ends of the tines are not interconnected, the carrier arms located on the outside are fully free to move along the outside of the inner carrier arms, so that the grab can be fully opened. During operation, and as a result of the closing force brought about by the closing ropes, the carrier arms are mainly subjected to bending loads, so that the main pivots can be made considerably simpler and in addition are easier to assemble and dissemble, while at the same time a considerable saving in weight is obtained. This saving in weight is even greater as the pulley box is accommodated in one bucket only, and has fewer pulleys. The additional result is that the reeving of the closing ropes is simpler and the reeved ropes are subjected to fewer bends.

Preferably, the stiffening plate extends from the tine tip in the direction of the sidewall of the associated bucket, and is connected therewith.

The end of each closing rope is fixed in a thimble holder which by means of a pin is pivotally connected to the end of a tine.

These tines offer the further advantage that their ends can be arranged more remote from the pivot of the grab, so that a larger closing force can be realised, both in the closed position of the grab and at the beginning of the closing movement in the open position of the grab.

In order that the buckets may have sufficient rigidity in the transverse direction, preferably each grab bucket is provided with transverse stiffening tubes parallel to the pivotal shaft, one stiffening tube being secured in one bucket between the carrier arms, and the other being secured in the other bucket between the carrier arms and the sidewalls of that bucket.

The guide pulleys of the pulley box of the grab are preferably arranged on the inside of the carrier arms nearest the longitudinal axis of the grab, while the "close" pulleys are located outwardly of the carrier arms.

In another embodiment, both the guide pulleys and the "close" pulleys are arranged inwardly of the carrier arms nearest the longitudinal axis of the grab, which carrier arms are slightly bent outwardly at the location of the "close" pulleys. The slightly off-set construction of the carrier arms makes the construction more expensive, it is true, but this is, at least partly, compensated by the considerably more favourable reeving pattern of the ropes in this embodiment.

If the grab according to the invention takes the form of a traverse grab, which means that the opening direction of the grab is located substantially in the plane containing the hoist and closing ropes of the crane from which the grab is suspended, the buckets are made to exhibit rotary symmetry. In this construction each grab bucket is provided with two parallel, planar carrier arms, one of which carries guide pulleys and "close" pulleys, and the other, together with a stiffening plate arranged in spaced relationship thereto, forms a tine, at the end of which a closing rope of the other bucket is secured, and, in the mounted condition, the carrier arm with the guide pulleys and "close" pulleys of one bucket is located between the tine and the carrier arm with the guide pulleys and "close" pulleys on the other grab bucket.

Some embodiments of the grab according to the invention will now be described in more detail, by way of example, with reference to the accompanying drawings. In said drawings:

FIG. 1 shows a grab according to the invention in the closed condition;

FIG. 2*a, b* show a plan view and a front-elevational view, respectively, of the grab shown in FIG. 1 in the open condition;

FIGS. 3*a,b* show views similar to FIGS. 2*a,b* of a slightly modified embodiment;

FIGS. 4*a,b* show a plan view and a diagrammatic front-elevational view, respectively, of a grab in an embodiment exhibiting rotary symmetry.

The grab 1 as shown in FIGS. 1, 2*a*, and 2*b* comprises grab buckets 2, 3 connected by means of suspension ropes or chains 4 to a yoke 5. This yoke 5 is connected by means of hoist ropes 7 to the crane. The closing ropes 6 extend from the crane top through yoke 5 to the pulley box 10, which forms part of bucket 2. The pulley box houses guide pulleys 12 and "close" pulleys 11. The end of a closing rope 6 is connected to the end of tine 9. Grab buckets 2, 3 are pivotable about a pivot shaft 8.

In FIG. 2*a*, the shape and configuration of the carrier arms or shear plates is illustrated. The left bucket 2 is provided with two shear plates or carrier arms 15,16, connected together by a stiffening tube 17, to which an eye 18 is secured for connecting a suspension rope 4 thereto. Shear plates 15, 16 extend from the bottom of bucket 2 to beyond the pivot shaft 8. Shear arms 15,16 are interconnected at the end by a protection plate 19 which prevents the closing ropes from contacting the bulk material being handled. In the space formed by the two shear plates 15,16 and protection plate 19 is the pulley box which comprises two guide pulleys 12 and two "close" pulleys 11. Guide pulleys 12 are located inwardly of shear plates 15, 16, the guide pulleys 11 are located outwardly of these shear plates. Sidewalls 20 of bucket 2 consist of Z-shaped bent plates, connected at one end of the pivot shaft 8.

The right-hand bucket 3, as shown in FIG. 2*a*, is provided with carrier arms or shear plates 22, 23, which extend from the bottom of bucket 3 to beyond the pivot shaft. Shear plates 22, 23 are located outwardly of shear arms 15, 16 of grab bucket 2, and can fully pass by the latter. Shear plate 23 together with stiffening plate 25 forms a fork tine, with plates 23 and 25 being interconnected at the end 27. Stiffening plate 25 extends from tine tip 27 in the direction of pivot shaft 8 and subsequently merges into side wall 21 of grab bucket 3. Similarly, shear plate 22 and stiffening plate 26 together form a fork tine, with plates 22, 26 being interconnected at their ends 28. At the position of the pivotal shaft, stiffening plate 26 merges into the sidewall 21 of grab bucket 3. Bucket 3 is stiffened in the transverse direction by means of tube members 24, arranged between shear plates 23, 22, respectively, and sidewalls 21 of bucket 3. Mounted on these stiffening tubes 24 are eyes 18 for securing suspension ropes 4 thereto. The location of the stiffening tubes 17 and 24 provides the possibility for the grab to be suspended from three rather than the usual four ropes, the effect of which is a better static weight distribution over ropes 4.

Closing rope 6 passes from the yoke (FIG. 1) around a guide pulley 12, a "close" pulley 11, and thence to a tine tip 27, 28. The end of the closing rope 6 is fixed in a thimble holder 29, mounted on a swivel bearing and pivoted by means of a pin 30 to tine tip 27,28. FIG. 2*b* shows that closing rope 6 is located well above the axis of pivotal shaft 8, the effect of which is a favourable closing characteristic of the grab. The closing characteristic of the grab is further favourably affected by the fact that all shear plates or carrier arms can extend beyond stiffening rods 17, 24 of buckets 2,3, so that longer lever arms can be selected than in the case of the shear grab described in Netherlands patent application No. 6711272, in which the shear arms must necessarily terminate in front of the transverse stiffening rods mounted in the grab buckets.

Figure 2:
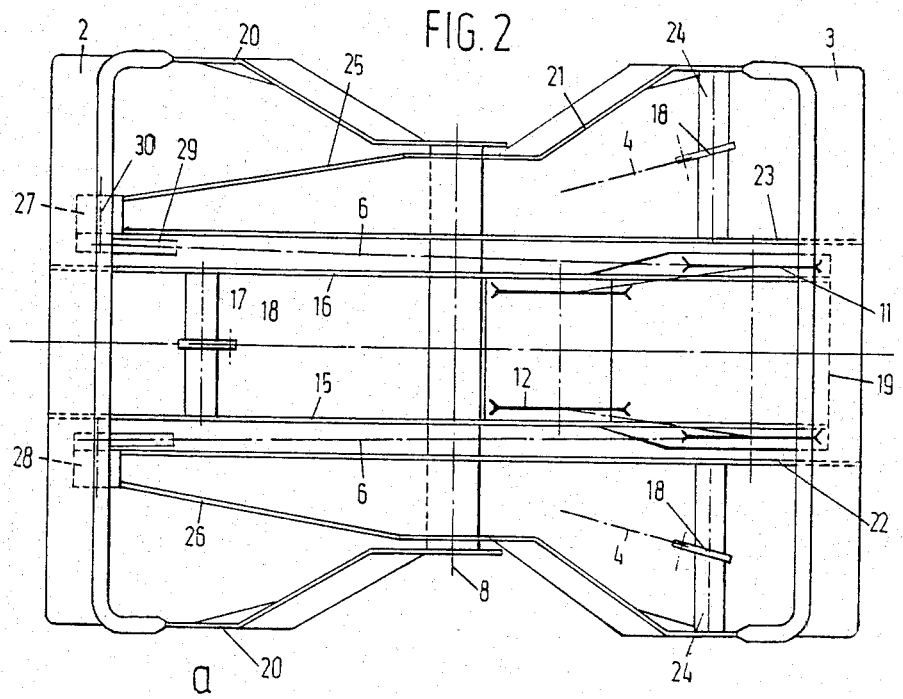
Figure 2:
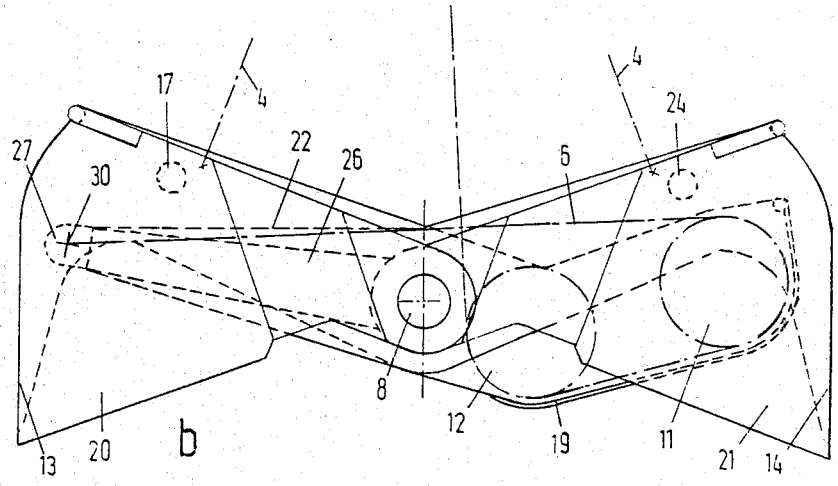
Figure 3:
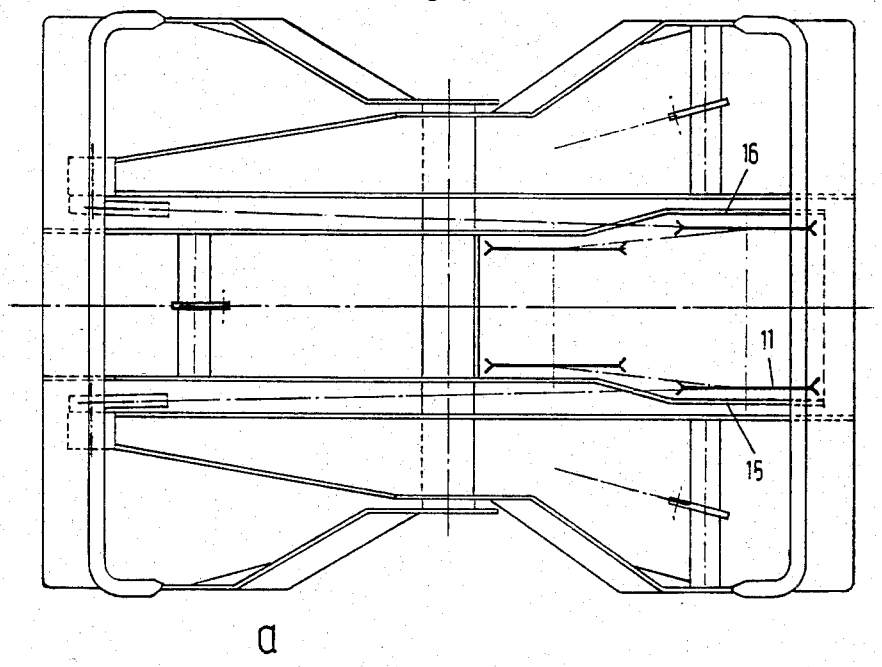
Figure 3:
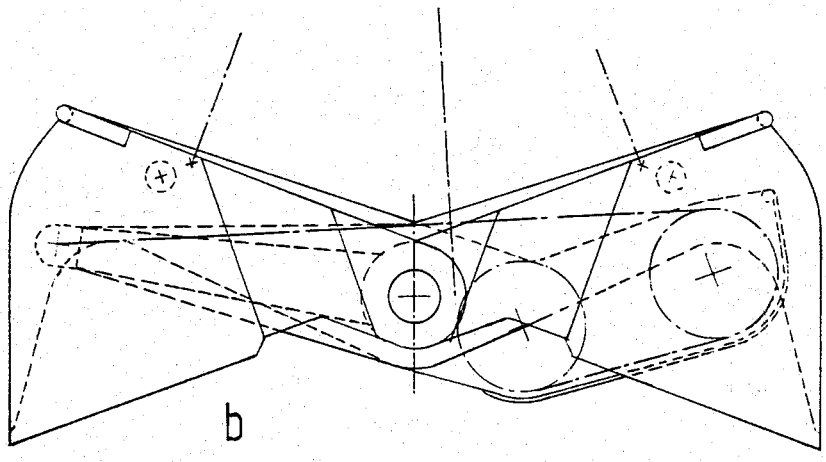

By virtue of the savings in weight than can be obtained with a grab shown in FIGS. 1–2, owing to various "close" and "push" pulleys being dispensed with, and owing to the lighter construction of the fork levers and the pivots, this fork shear grab makes it possible to use the lifting capacity of the crane with greater efficiency. With a grab of conventional construction, the ratio between the weight of the contents and the overall weight was 27.5 divided by 50, so that the efficiency is 0.55. With the fork shear grab according to the present invention, the weight of the contents could be increased from 27.5 to 30 ton, so that the efficiency is 30 divided by 50 which is 60%. The transfer capacity, too, is increased by a factor 30 divided by 27.5 is 1.09, or 9%.

The fork shear grab shown in FIGS. 3*a,b* corresponds to that of FIGS. 2*a,b* with the only difference being that, in the grab of FIG. 3*a*, the shear arms 15,16 are bent outwardly approximately halfway the pulley box, as a result of which the "close" pulleys 11 can be arranged inwardly of shear arms 15,16. This means that at the underside of guide pulleys 12, the control of closing ropes 6 need not be passed through shear arms 15, 16 to "close" pulleys 11, but can remain fully within the space enclosed by shear arms 15,16. This makes the reeving of the ropes more favourable, although this goes at the expense of a somewhat more expensive construction, because the shear plates 15,16 have to be bent outwardly.

Figure 4:
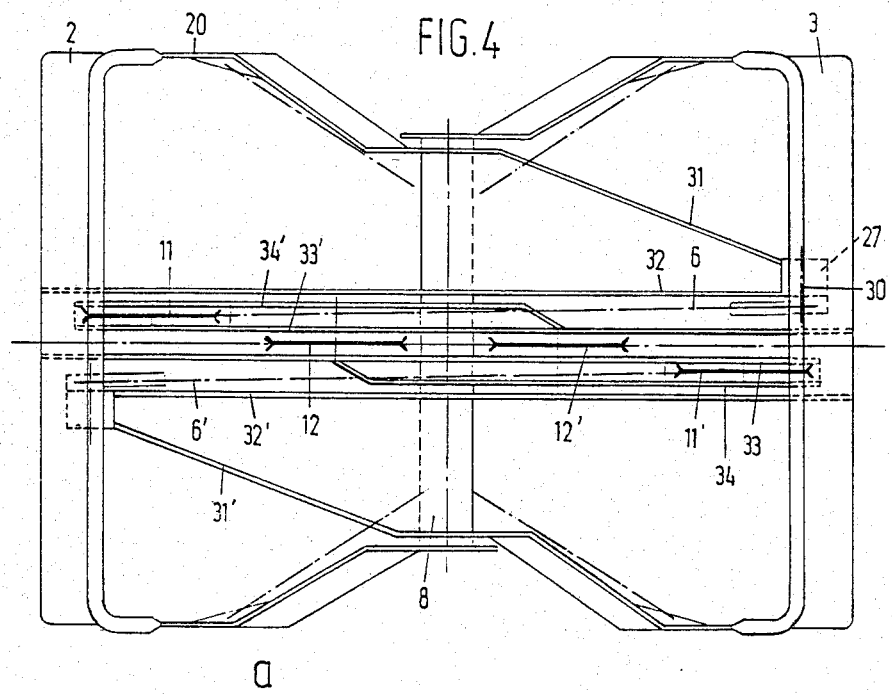
Figure 4:
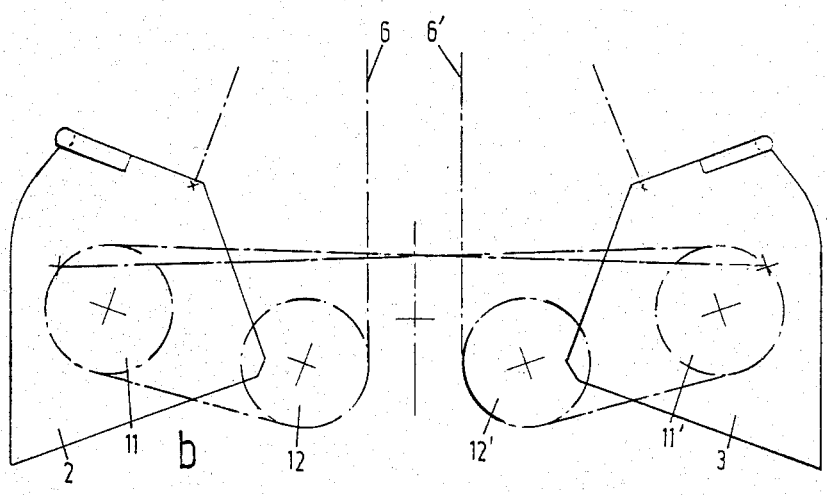

FIGS. 4*a, b* shows a particular embodiment of the fork shear grab according to the invention, namely in case it is desired for the fork shear grab to be constructed as a transvere grab. In the shear grab of FIGS. 1–3, the opening direction of the grab is in a plane perpendicular to the plane containing the two closing ropes 6, whereas in a transverse grab the opening direction must coincide with the plane containing the two closing ropes. A transverse grab must of course exhibit rotary symmetry, and this can be achieved by the variant of the grab of FIGS. 1–3 as shown in FIG. 4. The particular feature of this transverse grab relative to the embodiments described hereinbefore, is that each grab bucket is provided with one fork tine and a continuous shear arm or carrier plate extending parallel thereto, whereas, in the embodiments described hereinbefore, one of the grab buckets was in each case provided with two fork tines.

The grab bucket 2 shown in FIG. 4 is provided with a shear plate 32 extending from the bottom of bucket 2 longitudinally of the grab, and terminating in a fork tine 27. Mounted in spaced relationship to this shear plate 32 is a stiffening plate 31, extending from the tip of the tine in the direction of the pivot shaft 8, and merging into the sidewall 20 of bucket 2. Extending parallel to shear plate 32 is shear plate 33, also from the bottom of bucket 2. Shear plate 33 is of double-walled construction approximately from hinge shaft 8 onwards, by means of a plate 34 extending parallel to shear arm 33. Interposed between plates 33, 34 is "close" pulley 11', while guide pulley 12' is mounted inwardly of shear plate 33, which pulley 12' is of course journalled in plates 33, 34. Closing rope 6' passes round pulleys 12' and 11' and is next secured in a thimble holder connected to the fork tine of the other bucket 3, while the closing rope 6, which is connected to the fork tine 27 of bucket 2, passes round guide and "close" pulleys 11,12 associated with bucket 3.

Grab bucket 3 is entirely identical to grab bucket 2 and is likewise provided with a fork tine consisting of shear plate 32' and stiffening plate 31', while a shear plate 33' is provided parallel to shear plate 32', which plate 33' is of double-walled construction at the end by means of a plate 34'. Provided between plates 33' and 34' is "close" pulley 11, while guide pulley 12 is journalled inwardly of shear plate 33'.

During the assembly of the two identical grab bucket 2,3, one of the buckets is rotated through 180°, so that the shear plate 33' and plate 34' connected to it come to lie between shear plates 32 and 33 of bucket 2. Owing to this construction and manner of assembly, the fork shear grab is fully balanced, i.e., the left-hand bucket is as heavy as the right-hand bucket, and there is no danger for the grab to start rotating about an axis perpendicular to the closing rope 6,6', and located approximately at the level of yoke 5.

I claim:

1. A grab comprising:

a pivot shaft;

first and second buckets pivotally connected to the pivot shaft;

a yoke;

at least one suspension rope connecting the first and second buckets to the yoke;

first and second closing ropes connected to the second bucket to move the buckets between open and closed positions; and guide and close pulleys connected to the first bucket and engaging the closing ropes to guide movement thereof;

each bucket including a bottom; first and second side plates pivotally connected to the pivot shaft; and a pair of planar carrier arms, each arm secured to the bottom of the bucket, pivoted at the pivot shaft, and including an outward position extending outward from the pivot shaft;

wherein when the grab is in the open position, the carrier arms of the second bucket are outside the carrier arms of the first bucket;

the second bucket further including a first stiffening plate connected to an outward portion of a first carrier arm of the second bucket, extending therefrom, laterally outward from the carrier arms of the second bucket, and further connected to the pivot shaft, and a second stiffening plate connected to an outward portion of a second arm of the second bucket, extending therefrom, laterally outward from the carrier arms of the second bucket, and further connected to the pivot shaft.

2. A grab according to claim 1, characterized in that a first transverse stiffening tube parallel to the pivotal shaft (8) is secured in the first bucket (2) between the carrier arms (15,16) thereof, parallel to the pivot shaft (8); and another stiffening tube (24) is secured in the second bucket (3) between the carrier arms (22,23) and the sidewalls (21) thereof, parallel to the pivot shaft (8).

3. A grab according to claim 1, characterized in that the buckets are provided with transverse stiffening tubes, and the buckets are connected to the yoke (5) by means of three suspension ropes or chains (4), the lower ends of the suspension ropes or chains (4) being secured to eyes (18) provided on the transverse-stiffening tubes (17,24).

4. A grab according to claim 1, characterized in that the guide pulleys (12) are arranged inside the carrier arms (16,15) of the first bucket and close pulleys L11) are located outwardly of the carrier arms (15,16) of the first bucket.

5. A grab according to claim 1, characterized in that both the guide pulleys (12) and the close pulleys (11) are arranged inwardly of the carrier arms (15,16) of the first bucket and the carrier arms thereof are slightly bent outwardly at the location of the close pulleys (11).

6. A grab according to claim 1 wherein the first bucket further includes a protective plate connected to the carrier arms of the first bucket to form, with the carrier arms of the first bucket, a protective casing for the guide and close pulleys.

7. A grab according to claim 6 wherein:

the first stiffening plate and the first carrier arm of the second bucket form a first tine, and the first closing rope is connected thereto; and the second stiffening plate and the second carrier arm of the second bucket form a second tine, and the second closing rope is connected thereto.

8. A grab according to claim 7, characterized in that the first stiffening plate extends from the first tine toward an adjacent sidewall (21) of the second bucket (3), and is connected therewith; and the second stiffening plate extends from the second tine toward an adjacent sidewall of the second bucket, and is connected therewith.

9. A grab according to claim 1, characterized in that the end of each closing rope (6) is fixed in a thimble holder (29) which by means of a pin (30) is pivotally connected to the end of a tine (27,28).

10. A grab comprising:

a pivot shaft;

first and second buckets pivotally connected to the pivot shaft;

a yoke;

at least one suspension rope connecting the first and second buckets to the yoke;

each bucket including a bottom, p1 first and second side plates pivotally connected to the pivot shaft, a pair of carrier arms, each arm secured to the bottom of the bucket, pivoted at the pivot shaft, and including an outward portion extending outward from the pivot shaft, and a stiffening plate connected to the outward portion of one of the carrier arms, extending therefrom, laterally outward from the carrier arms, and further connected to the pivot shaft;

first and second guide pulleys, the first guide pulley rotatably supported by and located between the carrier arms of the first bucket, the second guide pulley rotatably supported by and located between the carrier arms of the second bucket;

first and second close pulleys, the first close pulley rotatably supported by a first carrier arm of the first bucket, and the second close pulley rotatably supported by the second carrier arm of the second bucket;

first and second closing ropes to move the buckets from an open position to a closed position, the first closing rope being connected to the first bucket, extending therefrom, around the second close and guide pulleys; the second closing rope being connected to the second bucket, extending therefrom, around the first close and guide pulleys.

11. A grab according to claim 10 wherein:

a first carrier arm of the first bucket includes first and second spaced apart sections, and the first close pulley is located between and rotatably supported by said spaced apart sections; and a first carrier arm of the second bucket includes first and second spaced apart sections, and the second close pulley is located between and rotatably supported by the spaced apart sections of the first carrier arm of the second bucket;

wherein the buckets are balanced and exhibit rotary symmetry relative to each other.

* * * * *